United States Patent [19]

Suzuki et al.

[11] Patent Number: 4,905,642

[45] Date of Patent: Mar. 6, 1990

[54] SIAMESE-TYPE CYLINDER BLOCK BLANK AND APPARATUS FOR CASTING THE SAME

[75] Inventors: Tetsuya Suzuki, Saitama; Masuo Ebisawa, Kawagoe; Kiyoshi Shibata, Saitama; Shigeo Kaiho, Oomiya; Akio Kawase, Ageo; Shuji Kobayashi, Kawagoe; Yoshikazu Kanzawa, Tsurugashima, all of Japan

[73] Assignee: Honda Giken Kogyo Kabushiki Kaisha, Tokyo, Japan

[21] Appl. No.: 794,498

[22] Filed: Nov. 1, 1985

[30] Foreign Application Priority Data

| | | | |
|---|---|---|---|
| Nov. 9, 1984 | [JP] | Japan | 59-236235 |
| Nov. 9, 1984 | [JP] | Japan | 59-236236 |
| Nov. 9, 1984 | [JP] | Japan | 59-236237 |
| Nov. 12, 1984 | [JP] | Japan | 59-238099 |
| Dec. 14, 1984 | [JP] | Japan | 59-263894 |

[51] Int. Cl.[4] ..... B27D 19/00

[52] U.S. Cl. ..... 123/195 R; 123/668

[58] Field of Search ..... 123/193 C, 668, 669, 123/195 R

[56] References Cited

U.S. PATENT DOCUMENTS

| | | | |
|---|---|---|---|
| 4,127,058 | 11/1978 | Rohrle | 123/193 C |
| 4,446,906 | 5/1984 | Ackerman et al. | 164/112 |
| 4,495,907 | 1/1985 | Kamo | 123/669 |
| 4,656,983 | 4/1987 | Anno | 123/195 H |

*Primary Examiner*—David A. Okonsky

*Attorney, Agent, or Firm*—Roberts, Spiecens & Cohen

[57] ABSTRACT

A siamese-type cylinder block blank which is composed so that upon the pouring a molten metal under a pressure, a sleeve of cast iron is cast in each cylinder barrel of a siamese-type cylinder barrel made of an aluminum alloy and consisting of a plurality of cylinder barrels connected in series. The cylinder block blank is characterized in that each sleeve cast presents a substantially oval configuration in section with the lengthwise axis parallel to the direction of cylinder barrels arranged, as a result of the reception of the solidification shrinkage force of each cylinder barrel.

14 Claims, 16 Drawing Sheets

AMOUNT OF SLEEVE EXPANSION (μ)
200
150
100
50
0
50
100
150
200
HEATING TEMPERATURE (°C)
De
a1
a2
a3
a4
T

AMOUNT OF SLEEVE EXPANSION (μ)
200
150
100
50
0
50
100
150
200
HEATING TEMPERATURE (°C)
De
a1
a2
a3
a4
T

SIAMESE-TYPE CYLINDER BLOCK BLANK AND APPARATUS FOR CASTING THE SAME

BACKGROUND OF THE INVENTION

1. Field of the Invention

The present invention relates to a siamese-type cylinder block blank and more particularly, to such a cylinder block blank in which a sleeve made of a cast iron is cast, upon the pouring of a molten metal under a pressure, in each cylinder barrel of a siamese-type cylinder barrel made of an aluminum alloy and consisting of a plurality of cylinder barrels connected in series, and an apparatus for casting the same.

2. Description of the Prior Art

In conventional siamese-type cylinder block blank, each sleeve presents a substantially oval configuration in section with the lengthwise axis perpendicular to the direction of cylinder barrels arranged because the opposed peripheral walls of the adjacent sleeves are strongly subjected to the pouring pressure of a molten metal during pouring of the latter under a pressure into a mold.

In this case, the configuration in section of each cylinder barrel at the solidification shrinkage thereof is substantially oval with the lengthwise axis parallel to the direction of cylinder barrels arranged and hence, each sleeve is subjected to the solidification shrinkage force of the aluminum alloy and intended to be deformed to follow the configuration in section of each cylinder barrel at its shrinkage, but the sleeve deformed is changed in the configuration at the pouring of molten metal to a slight extent.

This results in the configurations in section of each sleeve and barrel with their lengthwise axes offset approximately 90° from each other, causing the casting stress remaining in each sleeve to be ununiform around its inner peripheral surface. When the sleeve as it is in such a state is subjected to a working for its inner peripheral surface into a true circle to give a cylinder block, and this block is used to assemble an engine, the operation of the latter causes the amount of resulting sleeve thermally expanded to be ununiform around its circumference. For this reason, a clearance may be produced between a piston ring and the sleeve, resulting in an increased amount of blow-by gas and in a useless consumption of oil.

In addition, in the conventional cylinder blocks, the sleeve as cast has been cast in each cylinder barrel. On the outer peripheral surface of each sleeve, annular or spiral slip-off preventing grooves have been made at a predetermined pitch during the casting of the sleeve by the mold to extend in the circumferential direction over a predetermined length from the sleeve end to which a cylinder head is bound. The slip-off preventing groove is generally U-shaped in cross section.

However, the use of the sleeve as cast causes the close adhesion between the molten metal and the sleeve to be hindered because of the microporosity of the outer peripheral surface of such sleeve and thus, a very small clearance may be produced between the sleeve and the cylinder barrel. If the slip-off preventing groove is made into a U-shape in cross section, then a gas such as air is settled at the corners between the inner side and bottom surfaces of the groove during casting and is confined therein by the molten metal. This also causes a very small clearance to be produced between the sleeve and the cylinder barrel as described above. In a siamese-type cylinder block, the ajacent sleeves are very close to each other, and between these sleeves there is generally no portion of a water-jacket. Therefore, the heat at the portions of both the sleeves opposed to each other may be transferred in a shortest path to the water jacket through the barrel located between these sleeves, but if a very small clearance as described above is produced around the outer periphery at those portions of both the sleeves opposed to each other, such heat transfer path is disconnected, causing the release of heat of the sleeve not to be effected uniformly around its circumference. Thus, the efficiency in release of heat of the sleeve is reduced.

The shaping of individual slip-off preventing grooves by the mold results in a wide variation in depth thereof and in an unevenness in thickness of the sleeve at the slip-off preventing grooves and the land portions between the adjacent grooves.

In such a cylinder block, the amount of sleeve expanded is unniform around the circumference of the sleeve and hence, the same problems may arise as described above.

SUMMARY OF THE INVENTION

It is therefore an object of the present invention to provide a siamese-type cylinder block blank used to produce a siamese-type cylinder barrel in which the amount of each sleeve thermally expanded is uniform around the circumference of the sleeve during operation of engine.

It is another object of the present invention to provide an apparatus for casting such a cylinder block blank used to produce a siamese-type cylinder block in which the amount of each sleeve thermally expanded is uniform around the circumference of the sleeve during operation of engine.

To accomplish the above objects, according to the present invention, there is provided a siamese-type cylinder block blank in which a sleeve made of a cast iron is cast, upon the pouring of a molten metal under a pressure, in each cylinder barrel of a siamese-type cylinder barrel made of an aluminum alloy and consisting of a plurality of cylinder barrels connected in series, wherein each sleeve cast presents a substantially oval configuration in section with the lengthwise axis parallel to the direction of cylinder barrels arranged, as a result of the reception of the solidification shrinkage force of each cylinder barrel.

According to the present invention, there is also provided an apparatus for casting a siamese-type cylinder block blank in which a sleeve made of a cast iron is cast, upon the pouring of a molten metal under a pressure, in each cylinder barrel of a siamese-type cylinder barrel made of an aluminum alloy and consisting of a plurality of cylinder barrels connected in series, the apparatus comprising a mold having a siamese-type cylinder barrel molding cavity, an expanding mechanism provided at a place of the cavity at which each sleeve is disposed, for applying an expansion force to the sleeve, and a pair of sealing members adapted to be fitted respectively on the inner peripheral surfaces at the opposite openings of each sleeve.

With such an arrangement, the casting stress remaining in each sleeve is substantially uniform around the circumference of the sleeve to result in a good degree of balance in such stress. Therefore, the inner peripheral surface of each sleeve in this blank is subjected to a working into a true circle and if so, the amount of each resulting sleeve thermally expanded during operation of engine will be substantially uniform around the circumference of the sleeve. This suppresses the creation of a clearance between a piston ring and the sleeve to the utmost, thus making it possible to overcome the problems of an increase in amount of blow-by gas and a useless consumption of oil.

The removal of the casting surface from the entire outer periphery of the sleeve results in a good adhesion between the sleeve and a molten metal and consequently, any very small clearance can not be produced between the sleeve and the cylinder barrel. Therefore, the release of heat from the sleeve will be conducted uniformly over the circumference of the sleeve. In addition, the slip-off preventing groove causes the sleeve to be enlarged in surface area and hence, the efficiency in release of heat of the sleeve is also improved conjointly with the good adhesion. Further, the thickness of the sleeve becomes uniform at the slip-off preventing groove and the land portion.

In addition, if the slip-off preventing groove is shaped into a conjugate arc in cross section, a gas such as air can not be confined in the slip-off preventing groove by the molten metal, thereby making it possible to prevent any very small clearance being produced between the sleeve and the cylinder barrel.

Finally, with the aforesaid apparatus, it is possible to easily cast a blank of siamese-type cylinder block in which the casting stress remaining in each sleeve is substantially uniform around the circumference of the sleeve.

BRIEF DESCRIPTION OF THE DRAWINGS

The above and other objects, features and advantages of the invention will become apparent from reading the following description taken in conjunction with the accompanying drawings, in which:

FIG. 1 is a perspective view of the block taken by viewing it from the above;

FIG. 2 is a sectional view taken along the line II—II in FIG. 1;

FIG. 3 is a perspective view of the block, taken by viewing it from the below;

FIG. 4 is a sectional view taken along the line IV—IV in FIG. 2;

DESCRIPTION OF PREFERRED EMBODIMENTS

Figure 1:
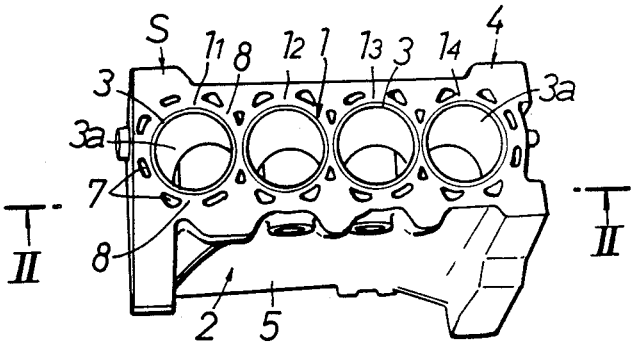
FIGS. 1 to 4 illustrate a in-line siamese-type cylinder block obtained from a blank according to the present invention.
Figure 2:
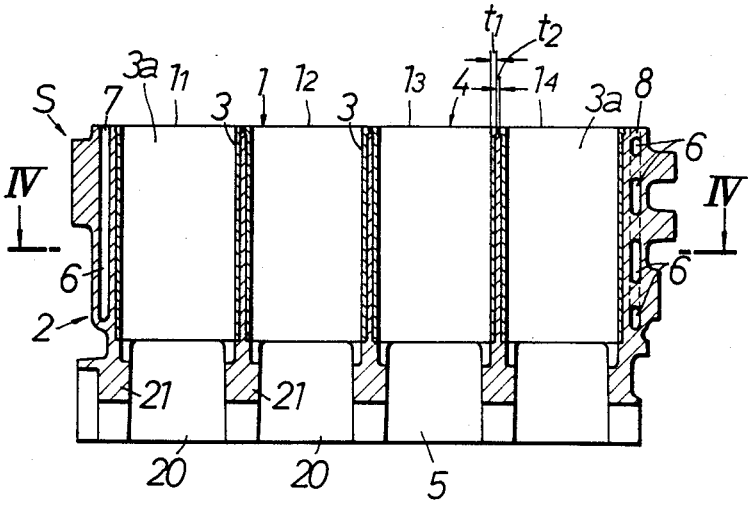

Referring to FIGS. 1 to 4, there is shown a in-line siamese-type cylinder block S obtained from a blank according to the present invention. The cylinder block S is comprised of a cylinder block body 2 made of an aluminum alloy and a sleeve 3 made of a cast iron and cast in the body 2. The cylinder block body 2 is constituted of a siamese-type cylinder barrel 1 consisting of a plurality of, e.g., four (in the illustrated embodiment) cylinder barrels $1_1$ to $1_4$ connected to one another in series, an outer wall 4 surrounding the siamese-type cylinder barrel 1, and a crankcase 5 connected to the lower edges of the outer wall 4. The sleeve 3 is cast in each the cylinder barrels $1_1$ to 14 to define a cylinder bore *3a*.

A water jacket 6 is defined between the siamese-type cylinder barrel 1 and the outer wall 4, so that the entire periphery of the siamese-type cylinder barrel 1 faces the water jacket 6. At the opening on the cylinder head binding side at the water jacket 6, the siamese-type cylinder barrel 1 is connected with the outer wall 4 by a plurality of reinforcing deck portions 8, and the space between the adjacent reinforcing deck portions 8 functions as a communication port 7 into a cylinder head. Thereupon, the cylinder block S is constituted into a closed deck type.

Figure 5:
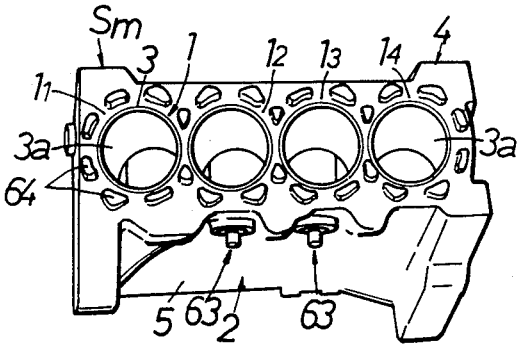
FIG. 5 is a perspective view of a siamese-type cylinder block blank according to the present invention, taken by viewing it from the above.
Figure 3:
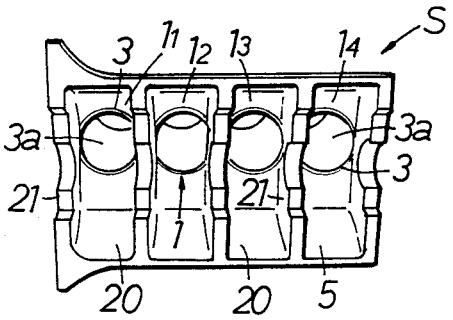
Figure 4:
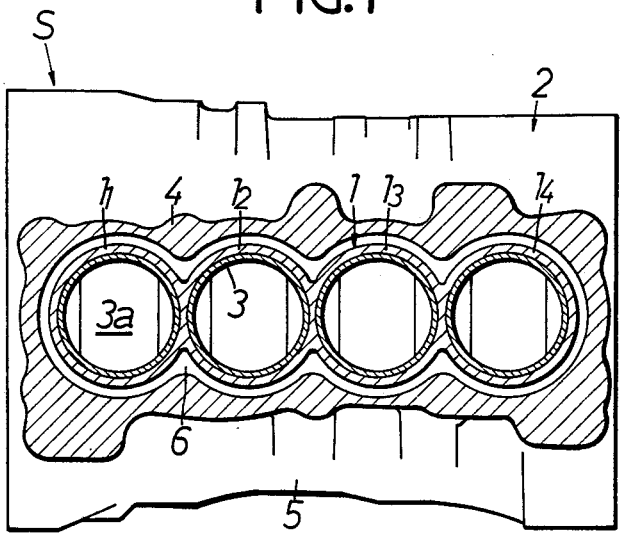

Referring to FIGS. 6 to 10, there is shown an apparatus for casting a cylinder block blank Sm according to the present invention shown in FIG. 5, which apparatus comprises a mold M. The mold M is constituted of a liftable upper die 9, first and second laterally split side dies $10_1$ and $10_2$ (see FIGS. 6 and 7) disposed under the upper die 9, and a lower die 11 on which both the side dies $10_1$ and $10_2$ are slidably laid.

Figure 7:
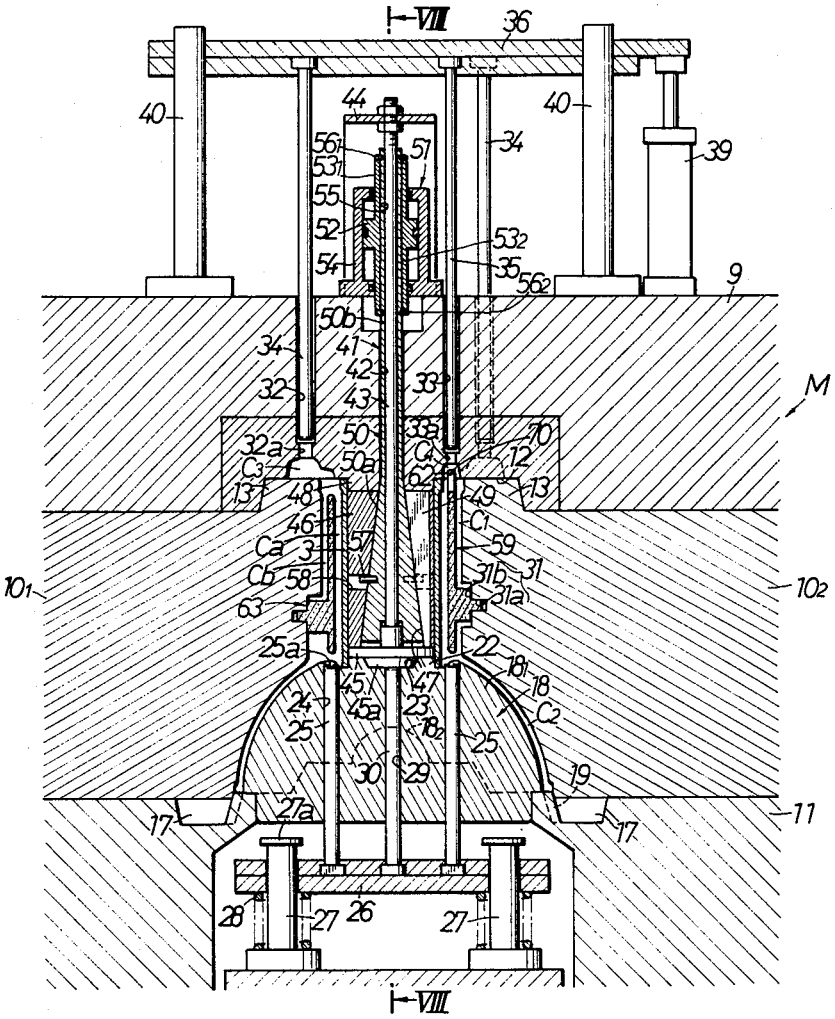
FIG. 7 is a front view in vertical section of the above casting apparatus when the mold is closed.

A clamping recess 12 is made on the underside of the upper die 9 to define the upper surface of a first cavity C1, and a clamping projection 13 adapted to be fitted in the recess 12 is provided on each the side dies $10_1$ and $10_2$. The first cavity C1 consists of a siamese-type cylinder barrel molding cavity Ca defined between a water-jacket molding sand core 59 and an expansion shell 46, and an outer wall molding cavity Cb defined between the sand core 59 and both the side dies $10_1$ and $10_2$, in the clamped condition as shown in FIG. 7.

Figure 8:
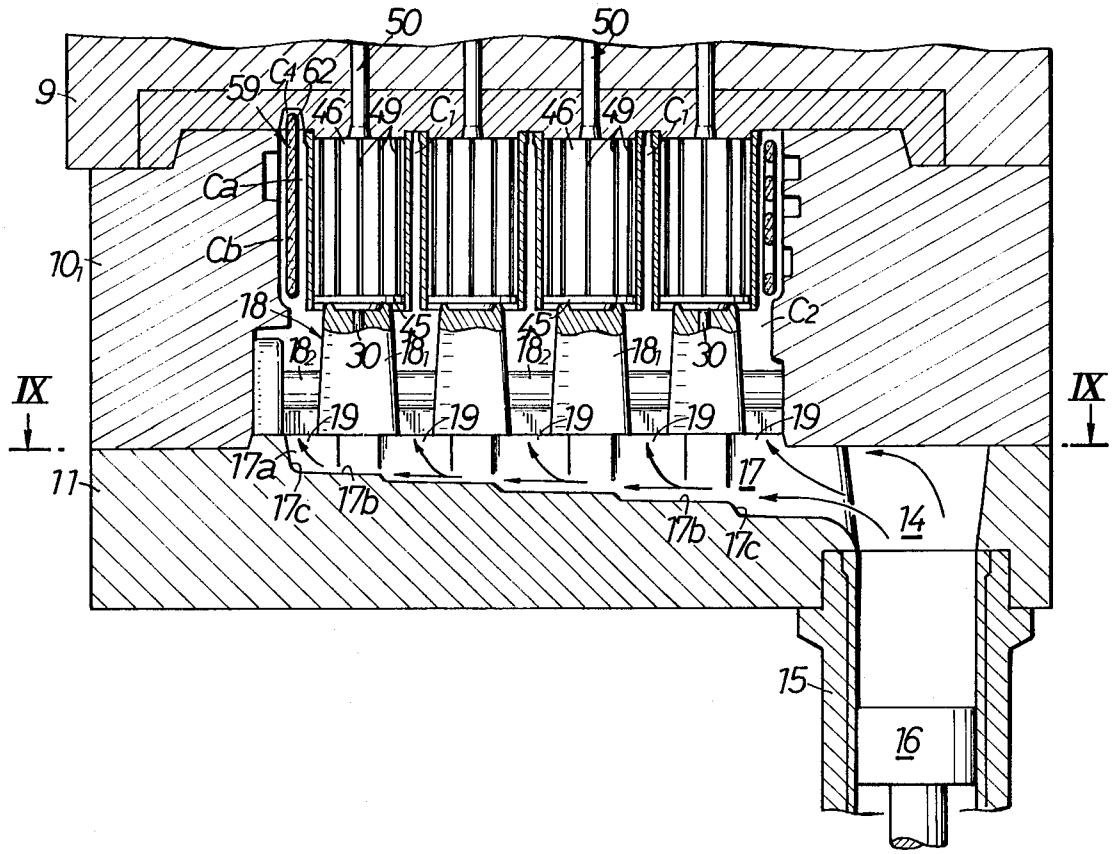
FIG. 8 is a sectional view taken along the line VIII—VIII in FIG. 7.
Figure 9:
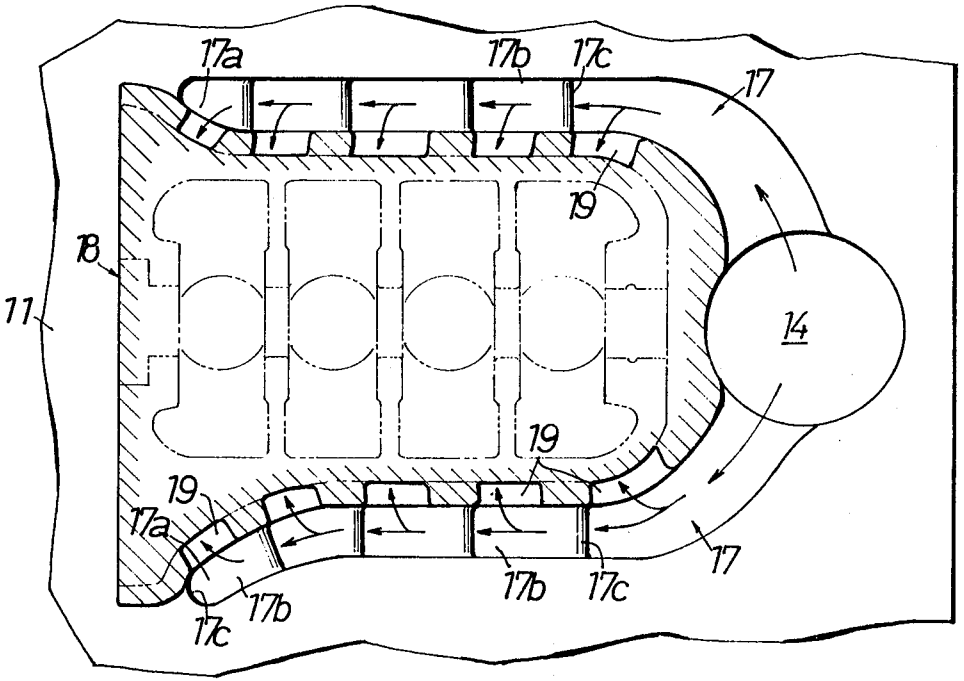
FIG. 9 is a sectional view taken along the line IX—IX in FIG. 8.

As shown in FIGS. 8 and 9, the lower die 11 includes a basin 14 for receiving a molten metal of aluminum alloy from a furnace (not shown), a pouring cylinder 15 communicating with the basin 14, a plunger 16 slidably fitted in the pouring cylinder 15, and a pair of runners 17 bifurcated from the basin 14 to extend in the direction of cylinder barrels arranged. The lower die 11 also has a molding block 18 projecting upwardly between both of the runners 17, and the molding block 18 defines a second cavity C2 for molding the crankcase 5 in cooperation with both the side dies $10_1$ and $10_2$. The cavity C2 is in communication at its upper end with the first cavity C1 and at its lower end with both the runners 17 through a plurality of gates 19.

The molding block 18 is comprised of four first taller semicolumnar molding portions $18_1$ formed at predetermined intervals, and second protruded molding portions $18_2$ located between the adjacent first molding portions $18_1$ and outside both of the outermost first molding portions $18_1$. Each first molding portion $18_1$ is used for molding a space 20 (see FIGS. 2 and 3) in which a crankpin and a crankarm are rotated, and each second molding portion $18_2$ is employed to mold a crank journal bearing holder 21 (see FIGS. 2 and 3). Each gate 19 is provided to correspond to each the second molding portions $18_2$ and designed to permit the charging or pouring of a molten metal in larger volume portion of the second cavity C2 in a early stage.

Both the runners 17 are defined with their bottom surfaces stepped in several ascending stairs to stepwise decrease in sectional area from the basin 14 toward runner extensions 17*a*. Each rised portion 17*c* connected to each the stepped portion 17*b* is angularly formed to be able to smoothly guide a molten metal into each the gates 19.

With the sectional area of the runner 17 decreasing stepwise in this manner, a larger amount of molten metal can be charged or poured, at the portion larger in sectional area, into the second cavity C2 through the gate 19 at a slower speed, and at the portion smaller in sectional area, into the second cavity through the gate 19 at a faster speed, so that the molten metal level in the cavity C2 raises substantially equally over the entire length of the cavity C2 from the lower ends on the opposite sides thereof. Therefore, the molten metal can not produce any turbulent flow and thus, a gas such as air can be prevented from being included into the molten metal to avoid the generation of mold cavities. In addition, a molten metal pouring operation is effectively conducted, leading to an improved casting efficiency.

Figure 6:
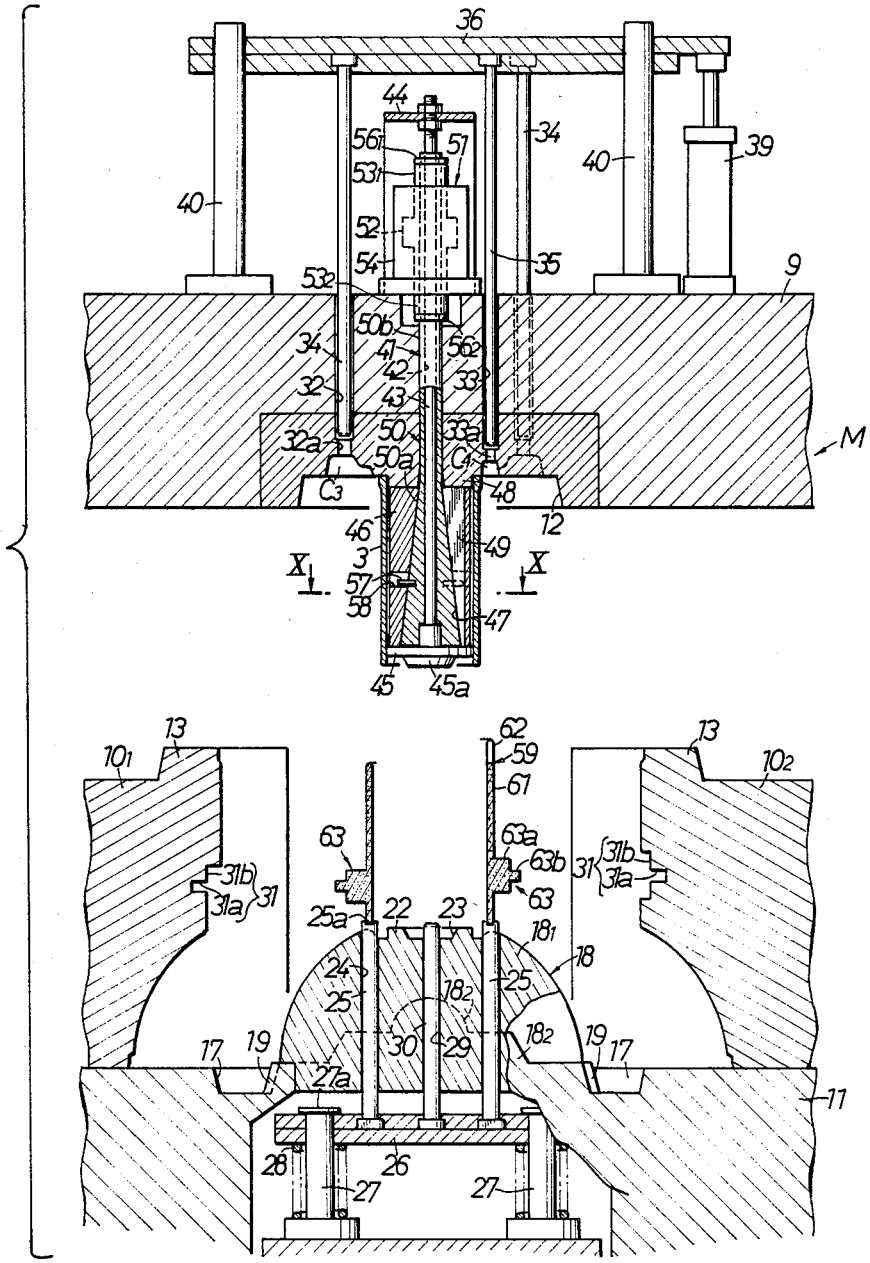
FIG. 6 is a front view in vertical section of the casting apparatus according to the present invention when a mold is open.

As shown in FIGS. 6 and 7, a locating projection 22 is provided on the top of each the first molding portions $18_1$ and adapted to be fitted in the circumferential surface of the sleeve 3 of cast iron, and a recess 23 is defined at the central portion of the locating projection 22. A through hole 24 is made in each of two first molding portions $18_1$ located on the opposite sides to penetrate the first molding portion $18_1$ on each the opposite sides of the locating projection 22. A pair of temporarily placing pins 25 are slidably fitted in the through holes 24, respectively, and are used to temporarily place the water-jacket molding sand core 59. The lower ends of the temporarily placing pins 25 are fixed on a mounting plate 26 disposed below the molding block 18. Two support rods 27 are inserted through the mounting plate 26, and a coil spring 28 is provided in compression between the lower portion of each the support rods 27 and the lower surface of the mounting plate 26. During opening the mold, the mounting plate 26 is subjected to the resilient force of each the coil springs 28 to move up until it abuts against the stopper 27*a* on the fore end of each the support rods 27. This causes the fore end of each the temporarily placing pins 25 to be protruded from the top surface of the first molding portion $18_1$. A recess 25*a* is made in the fore end of each the temporarily placing pins 25 and adapted to be engaged by the lower edge of the sand core.

A through hole 29 is made between the two first molding portions $18_1$ located on the opposite sides at the middle between both the through holes 24, and an operating pin 30 is slidably fitted in the through hole 29. The lower end of the operating pin 30 is fixed to the mounting plate 26. During opening the mold, the fore end of the operating pin 30 is protruded into the recess 23, and during closing the mold, it is pushed down by an expanding mechanism 41, thereby retracting both the temporarily placing pins 25 from the top surfaces of the first molding portions $18_1$.

A core bedding recess 31 for the sand core 59 to be really placed is provided at two places: in the central portions of those walls of the first and second side dies $10_1$ and $10_2$ defining the second cavity C2. Each the core bedding recesses 31 consists of an engaging bore 31*a* in which the sand core is positioned, and a clamp surface 31*b* formed around the outer periphery of the opening of the engaging bore 31*a* for clamping the sand core.

Made in the clamping recess 12 of the upper die 9 are a plurality of third cavities C3 opened into the first cavity C1 to permit the overflow of a molten metal and a plurality of fourth cavities C4 for shaping the communication holes 7. The upper die 9 also has gas vent holes 32 and 33 made therein which are communicated with each the third cavities C3 and each the fourth cavities C4, respectively.

Closing pins 34 and 35 are inserted into the gas vent holes 32 and 33, respectively, and are fixed at their upper ends to a mounting plate 36 disposed above the upper die 9.

The gas vent holes 32 and 33 have smaller diameter portions 32*a* and 33*a*, respectively, which extend upwardly a predetermined length from the respective ends, of the gas vent holes 32 and 33, communicating with the cavities C3 and C4, and which are fitted with the corresponding closing pins 34 and 35 so that the third and fourth cavities C3 and C4 may be closed.

A hydraulic cylinder 39 is disposed between the upper surface of the upper die 9 and the mounting plate 36 and operates to move the mounting plate 36 upwardly or downwardly, thereby causing the individual closing pins 34 and 35 to close the corresponding smaller diameter portions 32*a* and 33*a*. It is to be noted that the reference numeral 40 designates a rod for guiding the mounting plate 36.

The expanding mechanism 41, which is provided in the upper die 9 for applying an expansion force to the sleeve 3 cast in each the cylinder barrels $1_1$ to $1_4$, is constituted in the following manner.

A through hole 42 is made in the upper die 9 with its center line aligned with the axis extension of the operating pin 30, and a support rod 43 is loosely inserted into the through hole 42. The support rod 43 is fixed at its upper end to a bracket 44 rised on the upper surface of the upper die 9, and has as a sealing member a plate 45 secured at its lower end for blocking the entering of a molten metal. The blocking plate 45 is formed on its lower surface with a projection 45*a* which is fittable in the recess 23 at the top of the first molding portion $18_1$.

Figure 10:
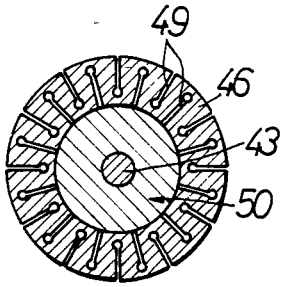
FIG. 10 is a sectional view taken along the line X—X in FIG. 6.

The hollow expansion shell 46 has a circular outer peripheral surface and a tapered hole 47 having a downward slope from the upper portion toward the lower portion. The lower portion of the support rod 43 projecting downwardly from the upper die 9 is loosely inserted into the tapered hole 47 of the expansion shell 46 whose upper end surface bears against a projection 48 rised as a sealing member on the recess 12 of the upper die 9 and whose lower end surface is carried on the blocking plate 45. As shown in FIG. 10, a plurality of slit grooves 49 are made in the peripheral wall of the expansion shell 46 at circumferentially even intervals to radially extend alternately from the inner and the outer peripheral surfaces of the expansion shell 46.

A hollow operating or actuating rod 50 is slidably fitted on the support rod 43 substantially over its entire length for expanding the expansion shell 46, and is comprised of a frustoconical portion 50*a* adapted to be fitted in the tapered hole 47 of the expansion shell 46, and a truly circular portion 50*b* continuously connected to the frustoconical portion 50*a* so as to be slidably fitted in the through hole 42 and protruded from the upper die 9. A plurality of pins 57 are protruded from the frustoconical portion 50*a* and each inserted into a vertically long pin hole 58 of the expansion shell 46 to prevent the expansion shell 46 from being rotated while permitting the vertical movement of the frustoconical portion 50*a*.

A hydraulic cylinder 51 is fixedly mounted on the upper surface of the upper die 9 and contains a hollow piston 52 therein. Hollow piston rods $53_1$ and $53_2$ are mounted on the upper and lower end surfaces of the hollow piston 52 and projected therefrom to penetrate the upper and lower end walls of a cylinder body 54, respectively. The truly circular portion 50*b* of the operating rod 50 is inserted into a through hole made through the hollow piston 52 and the hollow piston rods $53_1$ and $53_2$, and antislip-off stoppers $56_1$ and $56_2$ each fitted in an annular groove of the truly circular portion 50*b* is mounted to bear against the upper end surface of the hollow piston rod $53_1$ and the lower end surface of the hollow piston rod $53_2$, respectively, so that the hollow piston 52 causes the operating rod 50 to be moved up or down. The four expanding mechanisms 41 may be provided to correspond to the individual cylinder barrels $1_1$ to $1_4$ of the cylinder block S, respectively.

Figure 11:
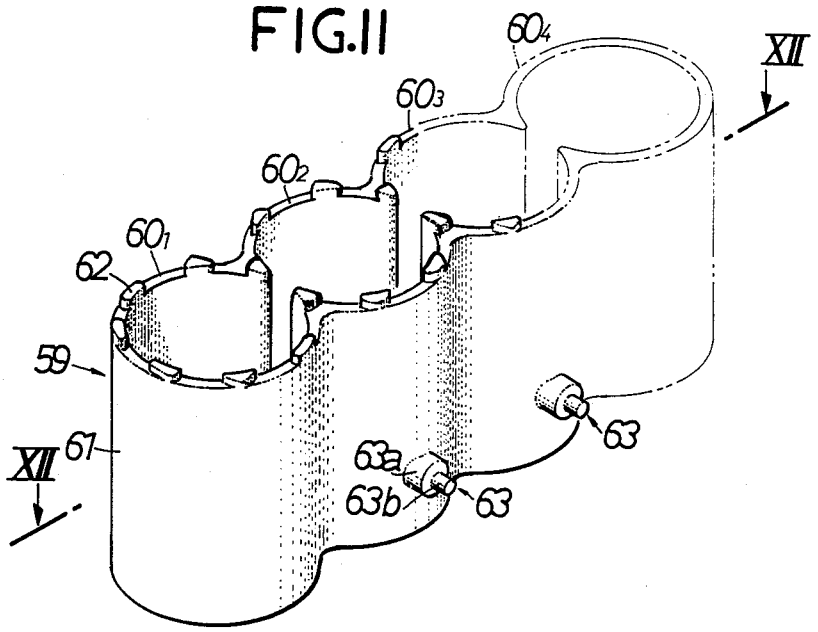
FIG. 11 is a perspective view of a sand core taken by viewing it from the above.
Figure 12:
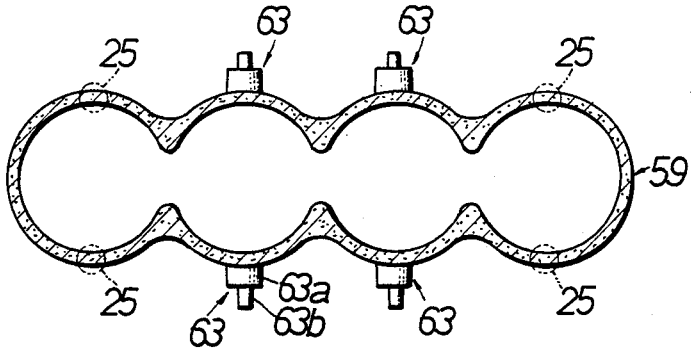
FIG. 12 is a sectional view taken along the line XII—XII in FIG. 11.

FIGS. 11 and 12 show the water-jacket molding sand core 59 which is constituted of a core body 61 comprising four cylindrical portions $60_1$ to $60_4$ corresponding to the four cylinder barrels $1_1$ to $1_4$ of the cylinder block S with the peripheral interconnecting walls of the adjacent cylindrical portions being eliminated, a plurality of projections 62 formed on the end surface of the core body 61 on the cylinder head binding side to define the communication ports 7 for permitting the communication of the water jackets 6 with the water jackets of the cylinder head, and a core print 63 protrudedly provided on the opposite (in the direction of cylinder barrels arranged) outer side surfaces of the core body 61, e.g., on the opposite outer side surfaces of two cylindrical portions $60_2$ and $60_3$ located between the outermost ones in the illustrated embodiment. Each the core prints 63 is formed of a larger diameter portion 63*a* integral with the core body 61, and a smaller diameter portion 63*b* rised on the end surface of the larger diameter portion 63*a*. In this case, the projection 62 is sized to be loosely fitted in the aforesaid fourth cavity C4.

Description will now be made of an operation of casting a cylinder block blank Sm in the above casting apparatus.

First, as shown in FIG. 6, the upper die 9 is moved up and both the side dies $10_1$ and $10_2$ are moved away from each other, thus conducting the opening of the mold. In the expanding mechanism 41, each hydraulic cylinder 51 is operated to cause the hollow piston 52 to move the operating rod 50 downwardly, so that the downward movement of the frustoconical portion 50*a* allows the expansion shell 46 to be contracted. In addition, the hydraulic 39 of the upper die 9 is operated to move the mounting plate 36 up. This causes the individual closing pins 34 and 35 to be released from the corresponding smaller diameter portions 32*a* and 33*a* respectively communicating with the third and fourth cavities C3 and C4. Further, the plunger 16 in the pouring cylinder 15 is moved down.

The substantially truly circular sleeve 3 of cast iron is loosely fitted in the each expansion shell 46, and the opening at the upper end of the sleeve 3 is fitted and closed by the projection 48 of the upper die 9. The end surface of the sleeve 3 is aligned with the lower end surface of the projection 45*a* on the blocking plate 45, while the opening at the lower end of the sleeve 3 is closed by the blocking plate 45. The hydraulic cylinder 51 of the expanding mechanism 41 is operated to cause the hollow piston 52 therein to lift the operating rod 50. The frustoconical portion 50*a* is thereby moved upwardly, so that the expansion shell 46 is expanded. Thereupon, the sleeve 3 is subjected to an expansion force and thus reliably held on the expansion shell 46.

As shown in FIGS. 6 and 12, the lower edges of the cylindrical portions $60_1$ and $60_4$ on the outermost opposite sides in the sand core 59 are each engaged in the recess 25*a* of the each temporarily placing pin 25 projecting from the top of each the first molding portions $18_1$ on the opposite sides in the lower die 11, thereby temporarily placing the sand core 59.

The side dies $10_1$ and $10_2$ are moved a predetermined distance toward each other to engage each core bedding recess 31 with each core print 63, thus really placing the sand core 59. More specifically, the smaller diameter 63*b* of each the core prints 63 in the sand core 59 is fitted into the engaging hole 31*a* of each the core bedding recesses 31 to position the sand core 59, with the end surface of each the larger diameter portions 63*a* parallel to the direction of cylinder barrels arranged being mated with the clamping surface 31*b* of the each core bedding recess 31 to clamp the sand core 59 by the clamping surface 31*b*.

As shown in FIG. 7, the upper die 9 is moved down to insert each the sleeves 3 into each the cylindrical portions $60_1$ to $60_4$ of the sand core 59, and the projection 45*a* of the molten metal-entering blocking plate 45 is fitted into the recess 23 at the top of the first molding portion $18_1$. This causes the projection 45*a* of the blocking plate 45 to push down the operating rod 30, so that each the temporarily placing pins 24 is moved down and retracted from the top surface of the first molding portion $18_1$. In addition, the clamping recesses 12 of the upper die 9 are fitted with the clamping projections 13 of both the side dies $10_1$ and $10_2$, thus effecting the clamping of mold. This downward movement of the upper die 9 causes the projection 62 of the sand core 59 to be loosely inserted into the fourth cavitie C4, whereby a space is defined around the projection 62. A space 70 for shaping the reinforcing deck portion 8 is also defined between the end surface of the sand core 59 and the inner surface of the recess 12 opposed to such end surface.

A molten metal of aluminum alloy is supplied out of a furnace into the basin 14 of the lower die 11, and the planger 16 is moved up to pass the molten metal through both the runners 17 and pour it into the second cavities C2 and the first cavities C1 from the opposite lower edges of the second cavities C2 via the gates 19. The application of this bottom pouring process allows a gas such as air in both the cavities C1 and C2 to be forced up by the molten metal and vented upwardly from the upper die 9 via the gas vent holes 32 and 33 in communication with the third and fourth cavities C3 and C4.

In the present case, both the runners 17 have the runner bottom stepped in a several upward stairs from the basin 14 so that the sectional area may decreases stepwise toward the runner extensions 17*a* as described above and hence, the upward movement of the plunger 16 causes a molten metal to be passed from both the runners 17 through the gates 19 and to be smoothly rised in the second cavities C2 substantially uniformly over the entire length thereof from the opposite side lower ends thereof. Thus, the molten metal can not produce a turbulent flow in both the cavities C1 and C2, and a gas such as air can be prevented from being included into the molten metal to avoid the generation of any mold cavity.

After the molten metal has been poured in the third and fourth cavities C3 and C4, the hydraulic cylinder 39 on the upper die 9 is operated to move the mounting plate down, thereby causing the closing pins 34 and 35 to close the smaller diameter portions 32*a* and 33*a* communicating with the cavities C3 and C4, respectively.

Figure 13:
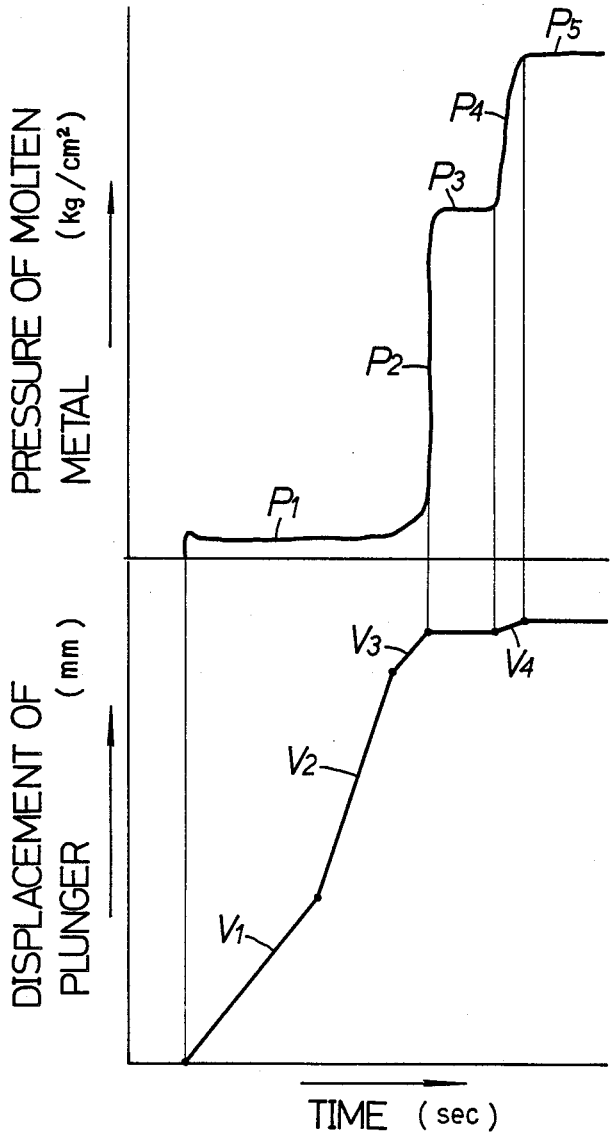
FIG. 13 is a graph representing the relationship between time and displacement of planger and the relationship between time and pressure of molten metal.

In the above pouring operation, the displacement of the plunger 16 for pouring the molten metal into the second and first cavities C2 and C1 and the pressure of the molten metal are controlled as shown in FIG. 13.

More specifically, the speed of plunger 16 moved is controlled at three stages of first to third velosities V1 to V3. In the present embodiment, the third velocity V1 is set at 0.08–0.12 m/sec., the second velocity V2 is at 0.14–0.18 m/sec., and the third velocity V3 is at 0.04–0.08 m/sec. to give a substantial deceleration. This control in velocity at three stages prevents the waving of the molten metal and produces a calm molten metal flow which can not include a gas such as air thereinto, so that the molten metal can be poured into both the cavities C2 and C1 with a good efficiency.

At the first velocity V1 of the plunger 16, the molten metal merely fills both the runners 17 and hence, the pressure P1 of the molten metal is kept substantially constant. At the second and third velocities V2 and V3 of the planger 16, the molten metal is poured or charged into both the cavities C1 and C2 and therefore, the pressure P2 of the molten metal rapidly increases. After the plunger 16 has been moved at the third velocity V3 for a predetermined period of time, the pressure P3 of the molten metal is maintained at 150–400 kg/cm$^2$ for a period of about 1.5 seconds, whereby the sand core 59 is completely enveloped in the molten metal to form a solidified film of molten metal on the surface thereof.

After the lapse of the above time, the plunger 16 is deceleratively moved at the velocity V4, so that the pressure P4 of the molten metal increases. When the pressure has reached a level P5 of 200–600 kg/cm$^2$, the movement of the plunger 16 is stopped, and under this condition, the molten metal is solidified.

If the pressure of the molten metal is kept constant for a predetermined period of time to form the solidified film of molten metal on the surface of the sand core 59 as described above, the sand core 59 can be protected by the film against breaking. In addition, the sand core 59 is expanded due to the molten metal, but because the projection 62 is loosely inserted in the fourth cavity C4, it follows the expansion of the sand core 59, whereby the folding of the projection 62 is avoided.

Since the sand core 59 is clamped in an accurate position by both the side dies $10_1$ and $10_2$ through each the core prints 63, it can not float up during pouring the molten metal into the first cavities C1 and during pressing the molten metal in the cavities C1. In addition, since the end surface of the larger diameter portion 63*a* of each core print 63 mates with the clamping surface 31*b*, as the sand core 59 is being expanded, the deforming force thereof is suppressed by each the clamping surfaces 31*b* to prevent the deformation of the sand core 59. Thus, a siamese-type cylinder barrel 1 is provided having a uniform thickness around each the sleeves 3.

As discussed above, a closed deck-type cylinder block blank can be cast with substantially the same production efficiency as in a die casting process, by controlling the speed of plunger 16 moved and the pressure of a molten metal.

After the completion of solidification of the molten metal, the hydraulic cylinder 51 of the expanding mechanism 41 is operated to move the operating rod 50 down, thereby eliminating the expansion force of the expansion shell 46 on the sleeve 3. The mold is opened to give a cylinder block blank Sm as shown in FIG. 5.

Figure 14A:
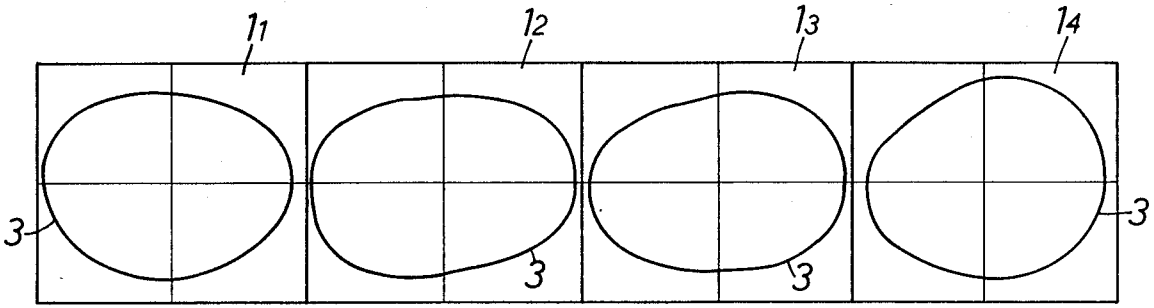
FIGS. 14A and 14B are a measurement diagram illustrating the results of TALLYROND measurements for the configurations in inner diameter of the sleeves of the siamese-type cylinder block blank according to the present invention and the sleeves in the comparative example, respectively.

In this cylinder block blank Sm, as shown in FIG. 14A illustrating a result of a TALLYROND measurement (100 times), the section of each sleeve 3 present a substantially oval configuration with a longitudinal axis parallel to the direction of cylinder barrels $1_1$ to $1_4$ arranged, which coincides with the configuration in section at the solidification shrinkage of each the cylinder barrels $1_1$ to $1_4$.

The reason why such a result is obtained is that the expansion force is applied on each sleeve 3 by the expanding mechanism 41 during pouring a molten metal so that each sleeve 3 is prevented from being deformed due the pouring pressure of the molten metal and that if the expansion force on each sleeve 3 is eliminated after the solidification of the molten metal is completed, then the each sleeve 3 is subjected to a solidification shrinking force and deformed in such a manner to follow the configuration in section of each the cylinder barrels $1_1$ to $1_4$.

Thereupon, the casting stress remaining in each sleeve 3 is distributed substantially uniformely over the entire periphery thereof.

Figure 14B:
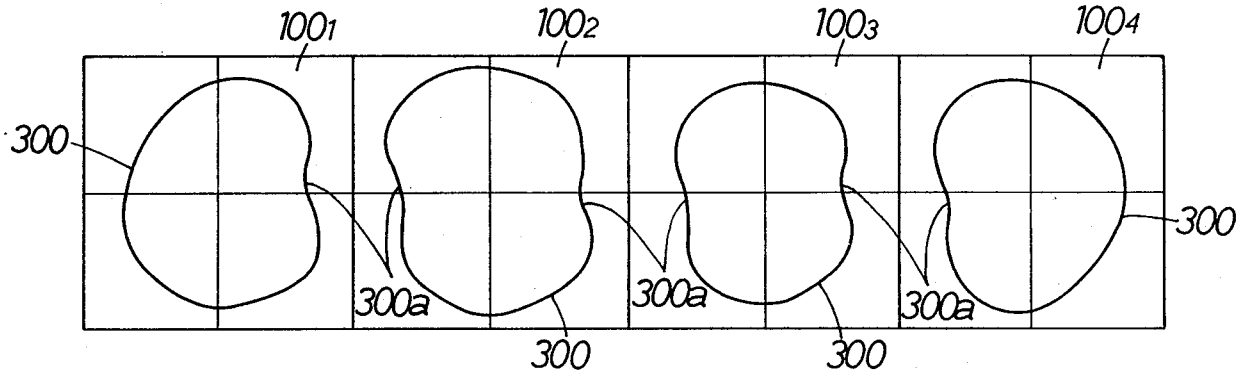

FIG. 14B illustrates a result of a TALLYROND measurement for a siamese-type cylinder block blank given as a comparative example by casting truly circular sleeves 300 into cylinder barrels $100_1$ to $100_4$ without employing the expanding mechanism 41. As apparent from this Figure, the configuration in section of each sleeve 300 presents an ellipse having a longitudinal axis perpendicular to the direction of cylinder barrels arranged and particularly, between the adjacent cylinder barrels, the opposed peripheral walls of both the sleeves are subjected to the pouring pressure of the molten metal and formed into a concave portion 300*a*, respectively.

Figure 15A:
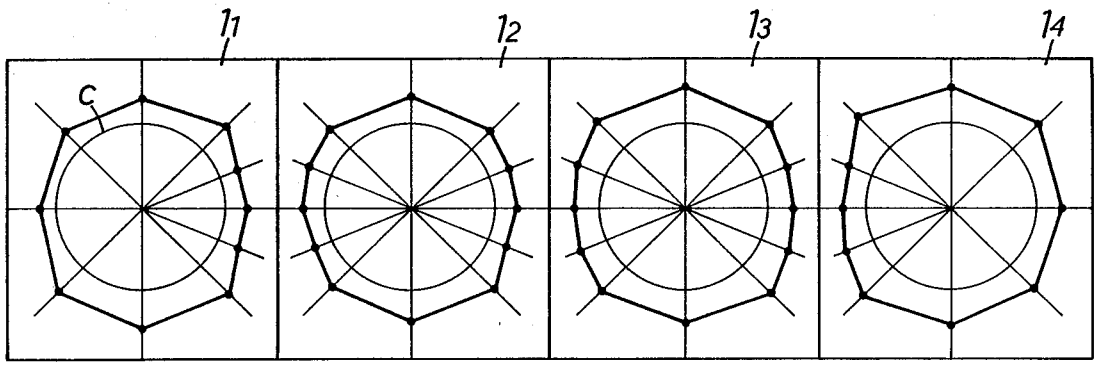
FIGS. 15A and 15B are a diagram illustrating the degree of balance in casting stress remaining in the sleeve of the siamese-type cylinder block blank according to the present invention and the sleeve in the comparative example, respectively.

FIG. 15A illustrates a degree of balance in casting stress remaining in each sleeve 3 of a cylinder block blank Sm according to the present invention, and in this Figure, the true circle c represents a zero point of casting stress. It is apparent from this Figure that a good degree of balance in casting stress is ensured over the entire periphery of each sleeve 3 with the above blank Sm.

Figure 15B:
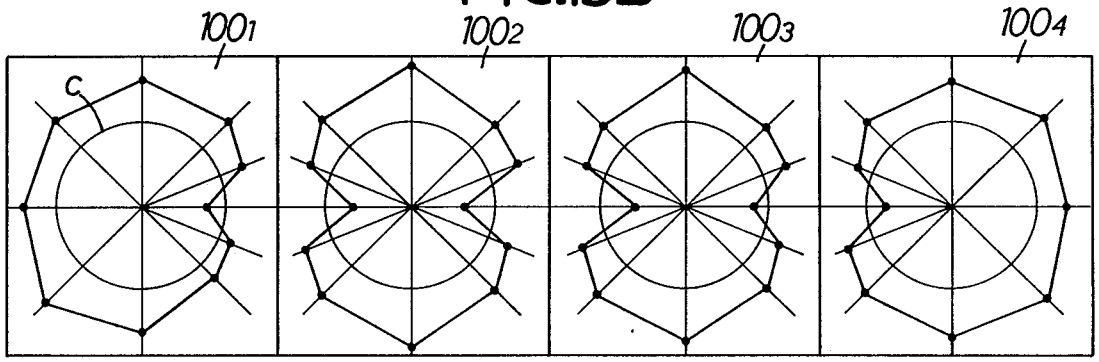

FIG. 15B illustrates a degree of balance in casting stress remaining each sleeve 300 in the above comparative example, and in this case, the adjacent cylinder barrels are specifically different from each other, resulting in an inferior degree of balance in casting stress.

After the aforesaid determination, when the protruded portions 64 (FIG. 5) each enveloping projection 62 of the sand core 59 are cut away from the cylinder block blank Sm according to the present invention, the projections 62 permits the communication holes 7 and the reinforcing deck 8 between the adjacent communication holes 7 to be made, respectively. Thereafter, the removal of the sand provides water jackets 6 and then, the inner peripheral surface of each sleeve 3 is subjected to a working into a true circle. Further, another predetermined working is also effected to give a cylinder block S as shown in FIGS. 1 to 4.

The cylinder block blank in the comparative example is also subjected to similar workings to give a cylinder block.

Figure 16B:
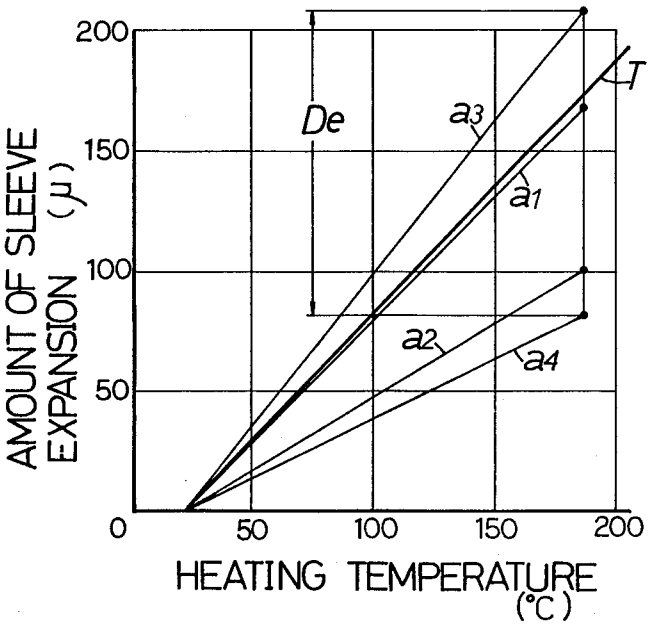
FIGS. 16A and 16B are a graph illustrating the relationship of amount of sleeve expanded with heating temperature for the sleeve of the siamese-type cylinder block obtained from the blank according to the present invention and the sleeve in the comparative example, respectively.
Figure 16A:
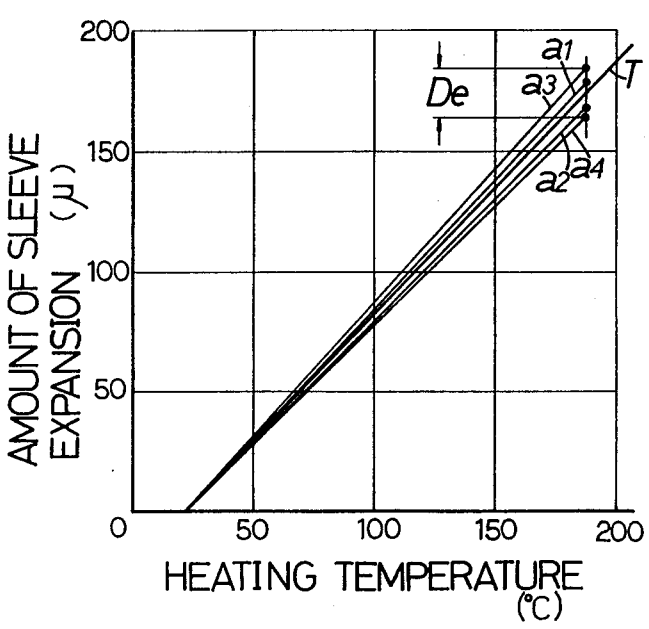
Figure 17:
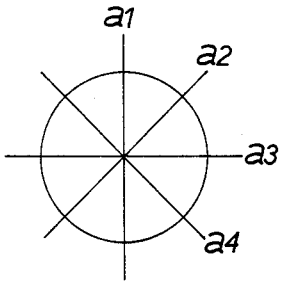
FIG. 17 is a diagram illustrating the position of measuring the amount of sleeve expanded.

FIGS. 16A and 16B illustrate the variation in inner diameter given as an expanded amount for both the sleeves 3 and 300 in the case where both the cylinder blocks is uniformly heated, respectively. The determination for the expanded amount was effected by determining the variation in inner diameter at four points a1 to a4 on the circumference, as shown in FIG. 17.

FIG. 16A illustrates such variation for the cylinder block S obtained from the blank according to the present invention. In this case, the difference De between maximum and minimum expanded amounts at a temperature of about 190° at which the cylinder block will be heated during the operation of an engine is as small as 20μ, and the expanded amounts at the individual points a1 to a4 are less distributed. Moreover, these expanded amounts approximate to a theoretical expanded amount T. This may be attributable to the good degree of balance in casting stress remaining in each sleeve 3 as described above.

FIG. 16B illustrates such variation in inner diameter for the cylinder block obtained in the comparative example. In this case, The difference De between maximum and minimum expanded amounts at the same temperature is as large as 128μ, and the expanded amounts at the individual points a1 to a4 are found to be distributed. Moreover, those at three points a2, a3 and a4 among these expanded amounts are largely apart from the theoretical expanded amount T. This may be caused by the inferior degree of balance in casting stress remaining in each the sleeves 300 as mentioned above.

In the cylinder block blank Sm according to the present invention, the configuration in section of each sleeve after cast exhibits a substantially oval shape with the lengthwise axis parallel to the direction of cylinder barrels arranged, and the casting stress remaining in each sleeve may be distributed substantially uniformly over the entire circumference of the sleeve, reading to a good degree of balance in such casting stress. Therefore, if the inner peripheral surface of each sleeve of the cylinder block blank Sm is subjected to a working into a true circle, the thermal expansion of each sleeve around its circumference in the resulting cylinder block is substantially uniform during the operation of the engine. Thereupon, any clearance may be suppressed to the utmost from being produced between a piston ring and the sleeve, thus making it possible to overcome problems of an increase in quantity of blow-by gas, an useless consumption of oil or the like.

In a process for casting a siamese-type cylinder block blank Sm as described above, if each sleeve is previously heated to a temperature of 150° to 700° C., it is possible to heat each sleeve by a molten metal substantially to the same temperature as the molten metal to reduce the rigidity thereof. After the solidification of the molten metal is completed, the expansion force on each sleeve is eliminated, so that each sleeve having a rigidity thus reduced is deformed in a manner to follow the sectional configuration of the cylinder barrel during the shrinkage of the latter. Thus, each sleeve is formed into a substantially oval shape in section with the lengthwise axis parallel to the direction of cylinder barrels arranged, and the casting stress remaining in each sleeve is substantially uniform around the circumference of the sleeve to result in a good degree of balance in such stress.

In this case, the thickness t1 of each sleeve 3 is set at a value which is 50% or more of a smallest thickness of the cylinder barrels $\mathbf{1}_1$ to $\mathbf{1}_4$ between the adjacent sleeves 3, i.e., the thickness t2 in the line interconnecting the centers of the adjacent sleeves 3. For example, with the thickness t2 of the most thin portion being of 4.5 mm, the thickness of each sleeve is set at 3 mm or more.

The examples of processes for casting such a cylinder block blank include a process comprising previously heating a sleeve of cast iron having a thickness of 5 mm to a temperature of 250° to 400° C. to conduct a casting operation as described above, subjecting the inner peripheral surface of the sleeve in the blank to a working into a true circle to finish it into a thickness of 3 mm, thus providing a siamese-type cylinder block.

In the process for producing the above siamese-type cylinder block, if the inner peripheral surface of each sleeve in the cylinder block blank is worked into a true circle to set the thickness of each sleeve at a value 50% or more of a smallest thickness t2 of cylinder barrels between the adjacent sleeves, each the sleeves is deformed to follow the sectional configuration of each the cylinder barrels during the shrinkage thereof because of the reduced rigidity thereof and thus formed into a substantially oval configuration in section with the lengthwise axis parallel to the direction of cylinder barrels arranged. For example, if the smallest thickness t2 of cylinder barrels $\mathbf{1}_1$ to $\mathbf{1}_4$ is of 6 mm, then the thickness t1 of each sleeve is set at 2 mm.

Examples of processes for making such a cylinder block include a process comprising conducting the same casting operation as described above using a sleeve of cast iron having a thickness of 3 mm to give a cylinder block blank, then subjecting the inner peripheral surface of the sleeve in such blank to a working into a true circle to finish the sleeve at a thickness of 2 mm, thus providing a siamese-type cylinder block.

Figure 18:
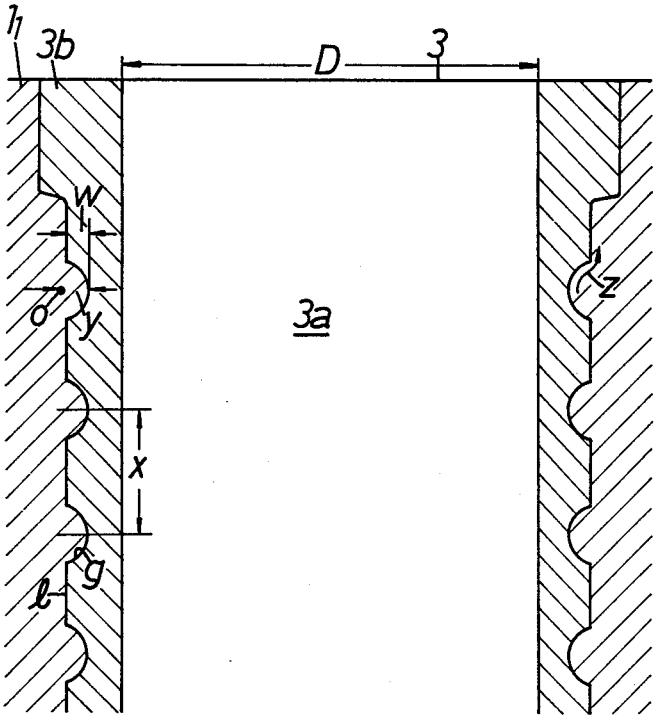
FIG. 18 is a sectional view showing the closely adhered portions between the sleeve and the cylinder barrel in an enlarged scale.

FIG. 18 illustrates the adhered portion between the sleeve 3 of cast iron and the cylinder barrel $1_1$ (or any one of $1_2$ to $1_4$). In this case, the casting surface on the outer periphery of the sleeve 3 is removed over the entire periphery by a mechanical working, and annular slip-off preventing grooves g are made in that outer periphery at a predetermined pitch by a mechanical working to form a plurality of conjugate arcs in cross section at least over a predetermined length from the end at which a cylinder head is bound and in the illustrated embodiment, over the entire length therefrom.

Each the slip-off preventing grooves g is sized such that with the inner diameter of the sleeve 3 represented by D, the depth of groove w=0.002D to 0.02D, the pitch between grooves x=0.01D to 0.10D, and the radius of groove y=0.002D to 0.04D. The reference character O designates a center of groove radius y.

The reason why dimensions of each groove g are limited is as follows: If the depth of groove w is below 0.002D, an anchoring effect by each slip-off preventing groove g is reduced so that each the sleeve 3 may be easily slipped off from the corresponding one of the cylinder barrels $1_1$ to $1_4$, while if such depth exceeds 0.02D, a molten metal is difficult to enter each the slip-off preventing groove g so that a clearance may be easily produced between the inner surface of each the grooves and each the cylinder barrels $1_1$ to $1_4$. In addition, with a pitch x between grooves being less than 0.01D, the sleeve 3 is reduced in circumferential rigidity, on the one hand, and with a pitch exceeding 0.10D, a surface area enlarging effect by each groove g is decreased so that the heat releasing property of the sleeve 3 is hindered, on the other hand. Further, with a radius y of groove less than 0.002D, a molten metal is difficult to enter each slip-off preventing groove g so that a clearance may be produced between the inner surface of each groove and each the cylinder barrels $1_1$ to $1_4$, while with a radius above 0.04D, the pitch between grooves is increased thereby decreasing the number of grooves g and a surface area enlarging effect by the grooves g is decreased so that the heat releasing property of the sleeve 3 is hindered.

The removal of the casting surface from the entire outer periphery of the sleeve in the above manner results in a good close adhesion between the sleeve and the molten metal, so that any very small clearance can not be produced between the sleeve and the cylinder barrel and consequently, the release of heat of the sleeve is conducted uniformly around its circumference. In addition, since the slip-off preventing groove causes the sleeve to be enlarged in surface area, the efficiency in release of heat of the sleeve is improved conjointly with the aforesaid good close adhesion. Moreover, the thickness of the sleeve is uniform at the slip-off preventing groove and the land portion. Further, the slip-off preventing groove g in each the sleeves 3 is formed into a conjugate arc and therefore, when a molten metal is poured into the siamese-type cylinder barrel molding recess Ca, the gas in the slip-off preventing groove g is forced up by the molten metal to flow smoothly along the circularly arcuate inner surface as shown by the arrow z in FIG. 18 and reliably discharged outside the grooves. As a result, a gas can not be confined in the slip-off preventing grooves g, leading to a good close adhesion between the sleeve and the molten metal.

Since each the slip-off preventing grooves g is formed by a machining, the accuracy in dimension thereof is satisfactory, leading to a uniform thickness of the sleeve 3 at the slip-off preventing groove g and the land portion l. If each slip-off preventing groove g is shaped by the mold, the depths thereof are distributed in a range up to about 1.0 mm. Also, if the groove g is formed into a superior arc or U-shape in cross section, a gas is apt to be settled in the groove g.

In a siamese-type cylinder block made using a sleeve 3 as described above, the amount of each sleeve 3 expanded is substantially uniform around its circumference during the operation of an engine.

The good close adhesion between the sleeve 3 and the molten metal has been observed by a microphotograph of metal. The slip-off preventing groove g of each sleeve 3 is not limited to an annular type, and may be spiral. Moreover, the sleeve g need not always to be provided over the entire length of the sleeve 3, and may be provided in a region from the cylinder head-bound end of the sleeve to the portion thereof opposed to the piston oil ring at a bottom dead point.

Figure 19:
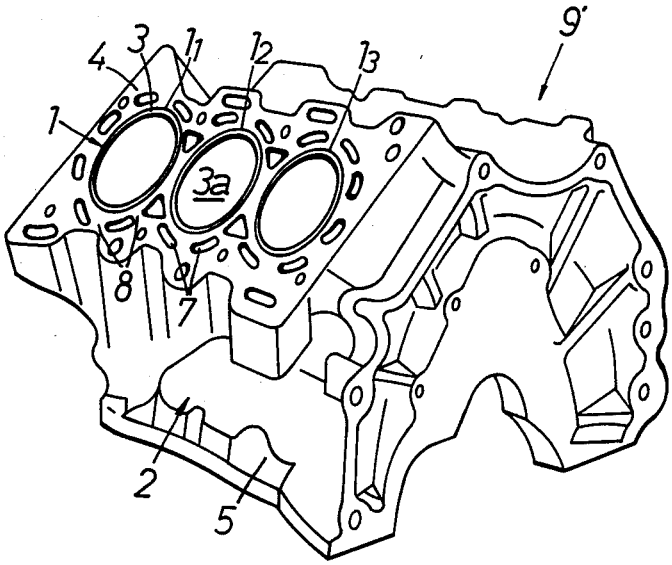
FIG. 19 is a perspective view of a V-shaped siamese-type cylinder block taken by viewing it from the above.

FIG. 19 illustrates a V-shaped siamese-type cylinder block S' including two siamese-type cylinder barrels 1. The cylinder block S' is also made by subjecting a cylinder block blank obtained through the same casting process to the same working as described above. Thus, the configuration in section of each sleeve is the same as in the abovementioned in-line cylinder block. In FIG. 19, the same reference characters are used to designate the same parts in the cylinder block S' as in FIG. 1.

What is claimed is:

1. A siamese-type cylinder block blank in which a sleeve of cast iron is incorporated, upon the pouring of a molten metal under a pressure, in each of a plurality of adjacent cylinder barrels of a siamese-type cylinder barrel made of an aluminum alloy, said cylinder barrels being connected in series, wherein each sleeve has a substantially oval cross section with a lengthwise axis parallel to the direction of the series arrangement of the cylinder barrels after completion of solidification due to application of solidification shrinkage force of each cylinder barrel on the respective sleeve.

2. A siamese-type cylinder block blank according to claim 1, wherein said cylinder block is of an in-line type.

3. A siamese-type cylinder block blank according to claim 1, wherein said cylinder block is V-shaped.

4. A siamese-type cylinder block blank according to claim 1, 2 or 3, wherein the outer periphery of each said sleeve has the casting surface removed therefrom over the whole, and annular slip-off preventing grooves are made at a predetermined pitch in said outer peripheral surface in the circumferential direction over a predetermined length from the cylinder head-bound end of said sleeve.

5. A siamese-type cylinder block blank according to claim 1, 2 or 3, wherein the outer periphery of each said sleeve has the casting surface removed therefrom over the whole, and spiral slip-off preventing grooves are made at a predetermined pitch in said outer peripheral surface in the circumferential direction over a predetermined length from the cylinder head-bound end of said sleeve.

6. A siamese-type cylinder block blank according to claim 4, wherein said slip-off preventing groove is formed as a conjugated arc in cross section.

7. A siamese-type cylinder block blank according to claim 6, wherein said slip-off preventing groove is sized such that with the inner diameter of said sleeve represented by D, the depth is 0.002D–0.02D, the pitch is at 0.01D–0.10D and the radius is at 0.002D–0.04D.

8. A siamese-type cylinder block blank comprising a siamese-type cylinder barrel made of a cast aluminum alloy and including a plurality of adjacent cylinder barrels connected in series alignment and a sleeve of cast iron incorporated in each cylinder barrel, each sleeve being of an oval cross-section due to application of solidification shrinkage force thereto by the associated barrel, the oval cross-section defining a longer longitudinal axis and a shorter transverse axis, the longitudinal axes of the sleeves being aligned parallel to the series alignment of the barrels in the solidified block blank.

9. A siamese-type cylinder block blank according to claim 8 wherein said cylinder block is of an in-line type.

10. A siamese-type cylinder block blank according to claim 9 wherein said cylinder block is V-shaped.

11. A siamese-type cylinder block according to claim 8 wherein each sleeve has a smooth machined outer peripheral surface and annular slip preventing grooves in said outer peripheral surface.

12. A siamese-type cylinder block according to claim 11 wherein said grooves are arcuate in cross section.

13. A siamese-type cylinder block according to claim 12 wherein D represents the inner diameter of the sleeve and said groove has a depth of 0.002D–0.02D, a pitch of 0.01D–0.10D and a radius of 0.002D–0.04D.

14. A siamese-type cylinder block according to claim 8 wherein each sleeve has a smooth machined outer peripheral surface and a spiral slip preventing groove in said outer peripheral surface.

* * * * *